United States Patent [19]

Iwasaki

[11] Patent Number: 4,643,605

[45] Date of Patent: Feb. 17, 1986

[54] DEVICE FOR PREVENTING DRYING OF NIB OF CARTRIDGE TYPE PEN

[76] Inventor: Kousei Iwasaki, 2-48-15 Horikiri Katsushika-ku, Tokyo, Japan

[21] Appl. No.: 570,222

[22] Filed: Jan. 12, 1984

[51] Int. Cl.[4] ..... B43K 9/00

[52] U.S. Cl. ..... 401/243; 401/202; 401/213; 401/245; 401/247

[58] Field of Search ..... 401/99, 213, 202, 247, 401/245, 107, 108

[56] References Cited

U.S. PATENT DOCUMENTS

| | | | |
|---|---|---|---|
| 3,446,563 | 5/1969 | Burnham | 401/202 X |
| 3,502,417 | 3/1970 | Hartman | 401/202 |
| 3,525,573 | 8/1970 | Fend | 401/108 |
| 3,554,658 | 1/1971 | Malm et al. | 401/202 X |
| 4,544,297 | 10/1985 | Grossiord | 401/99 X |

FOREIGN PATENT DOCUMENTS

| | | | |
|---|---|---|---|
| 2356981 | 5/1974 | Fed. Rep. of Germany | 401/245 |
| 2706951 | 8/1978 | Fed. Rep. of Germany | 401/213 |
| 3223722 | 12/1983 | Fed. Rep. of Germany | 401/213 |
| 2451273 | 3/1979 | France | 401/99 |
| 520233 | 3/1955 | Italy | 401/246 |
| 3612518 | 5/1961 | Japan . | |
| 19410 | 10/1910 | United Kingdom | 401/199 |

*Primary Examiner*—Steven A. Bratlie

*Attorney, Agent, or Firm*—Lucas & Just

[57] ABSTRACT

A device for preventing the drying of the nib of a cartridge type pen, wherein a cartridge type ink container provided with a nib and used to directly contain ink or contain an absorbent loaded with the ink and to supply the ink to the nib through a relaying material, a vent hole is made in a nose cone of the ink container at a position close to the nib, packing is provided between the outside peripheral surface of the ink container and a penholder at the position close to the vent hole to prevent the vent hole from communicating with the outside air, the nib is provided with elastic material such as rubber and plastics in the cap, a blind hole is made in the lower end surface to insert the nib, the opening of the blind hole is shut at the front end of the nose cone of the holder or the front end of the nose cone of the ink container to cut off the communication of the inside of the blind hole with the outside air, and both used to cut off the communication of the vent hole with the outside air by means of the packing is employed to prevent the ink in the nib from drying up.

5 Claims, 9 Drawing Figures

DEVICE FOR PREVENTING DRYING OF NIB OF CARTRIDGE TYPE PEN

BACKGROUND OF THE INVENTION

Heretofore, there have been proposed numerous inventions and devices for preventing ink from drying in cartridge type writing equipment such as fiber pens using compacted fibers and ball point pens using small balls, wherein the container used to store ink in its absorbent and to relay the ink with another absorbent to the fiber nub or the ball as a nib is prepared separately from the pen holder, so that the container for supplying ink at need can be replaced with a new one. However, prior art pens have the disadvantages of being expensive because of complicated construction and the numerous parts which require much trouble and, should they be simple in construction, incapable of properly preventing ink from drying. On the other hand, although new cartridges for replacement are provided with caps for protecting ink from drying, those fitted in the holders are ready for use and the ink contained therein must be prevented from drying during two to three months normally required until they are purchased by users from manufacturers through distributors.

The present invention is intended to prevent ink from drying with a pen quite simple in construction, which is entirely new and basically different from the conventional one.

SUMMARY OF THE INVENTION

By providing a vent hole in the nose cone formed at the front end of an ink cylinder separately from or uniformly with the ink cylinder, the vent hole is used to make a nib airtight by inserting an O-ring in between a pen holder and the ink cylinder and to stop the circulation of air in the pen holder, and to prevent the ink in the ink cylinder from drying, so that the pen thus simply constructed can accomplish the object of preventing the ink from drying.

DESCRIPTION OF THE PREFERRED EMBODIMENT

An object of the present invention is provide an inexpensive pen simple in construction and capable of preventing ink in the nib from not only drying but also from being exhausted. The improvement in the device for preventing ink in the nib from drying up comprising a vent hole made in the nose core to which the nib is fitted for the pen of for example the cartridge type, wherein a plastic, ball, compacted fiber nib or the like is attached to the nib of an ink container, which is replaced with a new one when the ink has been exhausted.

Another object is to prevent the nib from communicating with the outside air and the ink absorbent in the ink container from drying up. This is done by making the vent hole in the nose cone close to the nib and by preventing the vent hole from communicating with the outside air and the inside of the ink container.

Still another object is to accomplish the above objects simply by fitting packing across the periphery of the nose cone and the pen holder.

Further object is to provide the packing in such a manner that it can be readily adjusted to the various shapes of the ink container and the pen holder and the sizes of the diameter.

Figure 1:
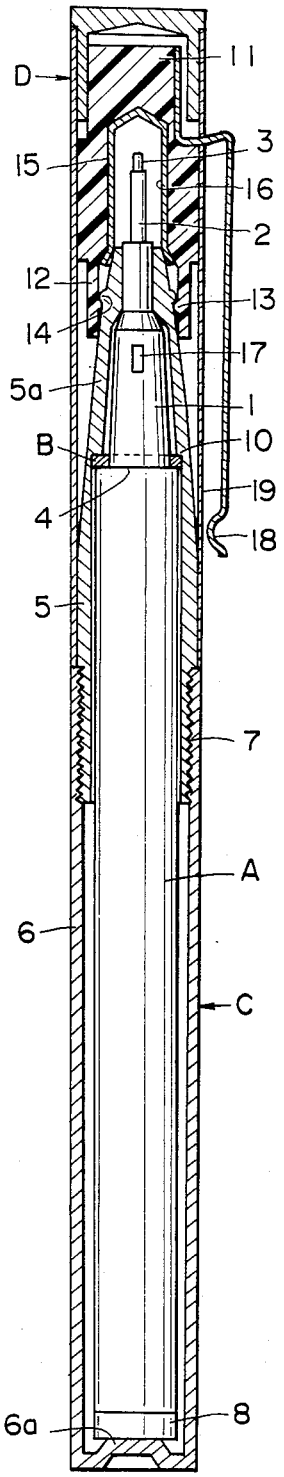
FIG. 1 is a vertical sectional view of the whole body.
Figure 2A:
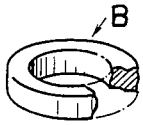
FIG. 2 is a perspective view of a packing: a, b and c are square, circular and projected in cross-section.
Figure 2B:
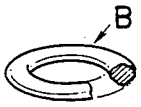
Figure 2C:
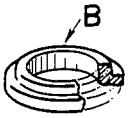

Referring now to the drawings, the present invention will be briefly described. Alphabet A indicates a cartridge type ink container and a fine tube 2 is fitted to the front end of nose cone 1 and then a nib 3 formed with a plastic lever, elastic compacted fibers, or a know ball point is contained in this fine tube 2. The nose cone 1 may be incorporated in the ink container A or prepared separately therefrom with a smaller diameter and is tapered in the direction of the front end of the fine tube 2 and provided with the fine tube 2 having the nib 3, whereas a tiered portion 4 is formed between the fine tube 2 and the ink container A and a vent hole 17 is made close to the front end. A tiered portion 10 of the tiered portion 4 facing downward is provided on the upper holder 5 as shown in FIG. 1 and packing B is attached to the under surface of the tiered portion 10. When the ink container A is inserted, the tiered portion 4 is used to press the packing B to allow the vent hole 17 of the nose cone 1 to shut the gap between the periphery of the ink container A and the inside peripheral surface of the holder C to cut off the ventilation and furthermore to cut off the ventilation between the inside of the ink container A and the vent hole 17. As shown in FIG. 2, the packing B is shaped in the form of a ring being square in cross-section in FIG. 2*a*, circular in 2*b* and projected in 2C, so that it can cope with the shapes of the ink container A and the holder C and the size of the diameter. The packing is prepared by punching a rubber or plastic plate and its thickness can be adjusted by preselecting the thickness of the plate. By dividing the holder (described later) into two pieces 5, 6 as shown in FIG. 1 and providing male and female ridges 7, the packing B is tightened to completely cut off the ventilation.

Alphabet C is the penholder divided into two holders 5, 6 and made detachable by means of the ridges 7 at the fitting ends thereof. The packing B attached to the tiered portion 4 of the ink container A is spirally pressed toward the screwing direction, whereas the bottom 6*a* of the lower holder 6 is projected and supplied with an elastic material 8 to shut the bottom by utilizing the elasticity of the packing B. The vent hole 17 made in the nose cone 1 is employed to shut the gap between the periphery of the ink container A and the holders 5, 6 to cup off the circulation of the air therebetween and accordingly the ink in the nose cone 1 is prevented from drying up.

Alphabet D shows a cap wherein an internal cylinder 11 made of rubber, plastic or other elastic materials is fixed, a recessed hole 15 for inserting the nib 3 is made in it lower part, an engaging cylinder 12 having thin wall thickness is provided in the opening of the recessed hole 15, a circular projection 13 downwardly inclined toward the inside peripheral surface is provided, and a circular projection 14 formed close to the front end of the nose cone 5*a* of the upper holder 5 is inserted beyond the circular projection 13, so that the nib 3 is prevented from drying as both the projections make tight contact with each other and the inside of the recessed hole 15 airtight. Moreover, if a soft bag-shaped cylinder 16 made of rubber or plastics is fixed to the inside peripheral surface of the hole 15 to stick the front end of the nose cone together, better airtightness will be established. The airtightening device with the packing B is used to completely prevent the range of the nib 3 and the range of the ventilation of the vent hole 17 from communicating with the outside air and to prevent the ink from drying up. When the nib 3 is used for writing by removing the cap D, because the cap is pulled and removed, the air is moved from the vent hole 17 to the nib 3 and the ink therein is caused to lead the ink to the nib 3 and to fill the nib 3 with the ink enought to facilitate writing.

Figure 3:
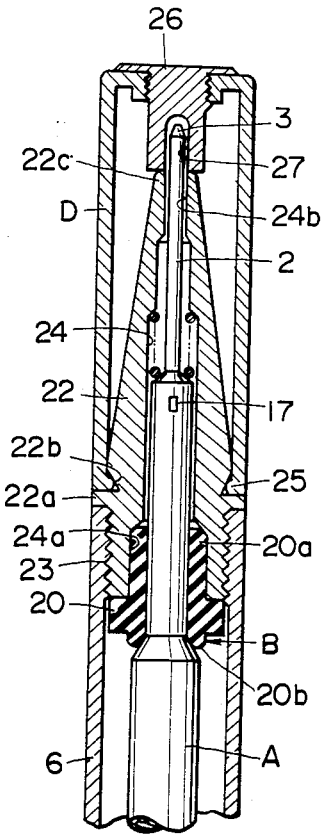
FIG. 3 is another examplary embodiment of the present invention illustrating a cap and packing.
Figure 4A:
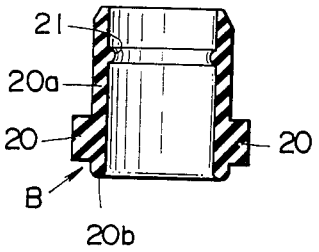
FIG. 4 is still another exemplary embodiment illustrating packing.
Figure 4B:
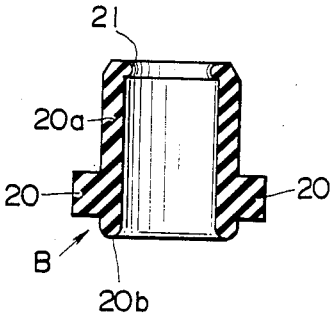

FIG. 3 shows other examples of the packing B and the cap D in FIG. 1, wherein a cylinder 20*a* incorporated in the upper surface of the edge 20 the packing B and a projected edge 20*b* is provided on the under surface thereof. The packing B shown in FIG. 4*a* is another example, wherein a circular projection 21 is formed close to the upper end of the inside peripheral surface of the cylinder 20*a*, whereas the packing B shown in FIG. 4*b* is still another example, wherein the circular projection 21 on the inside peripheral surface is provided in the upper end opening, so that the airtightness can be secured. Numeral 22 is a nose cone 22 and engaged by male and female ridges 23 to allow it to be removed toward the upper end of the holder 6. The inside central hole of the nose cone 22 has the largest diameter 24*a* for fitting the packing B and gradually has a small diameter toward the front end and a hole 24*b* for inserting the fine tube 2 of the nib 3 at the front end has the smallest diameter. A circular recessed groove 22*b* is formed in the upper surface of the edge 22*a* to make it possible for a circular projection 25 on the inside peripheral surface of the cap D to tightly engage with the groove. Numeral 26 indicates a plug-like body and the nib 3 is inserted in a blind hole 27 made in the lower end surface so as to let the front end of the nose cone 22 tightly attached thereto to cut off the inside of the blind hole 27 from the outside air. Other effects are the same as those shown in FIG. 1.

Figure 5:
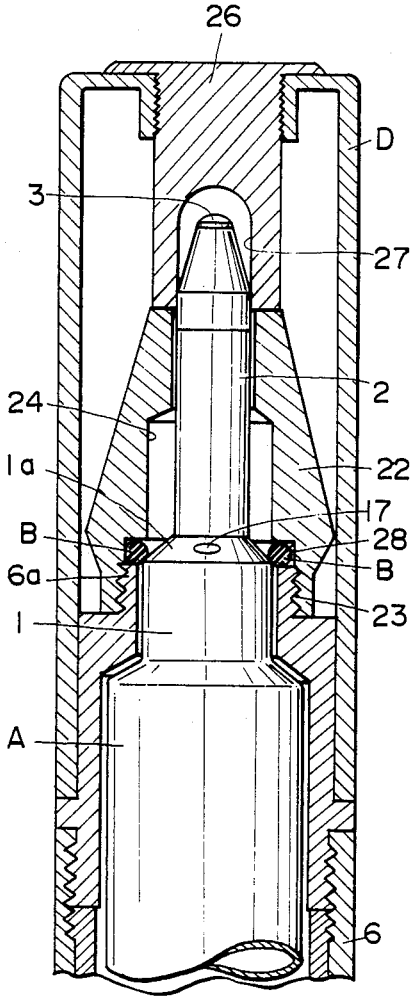
FIGS. 5 and 6 are enlarged vertical sectional views of principal portions while the packing is installed.

FIG. 5 shows an example illustrating the use of the packing B shown in FIG. 1 for the nose cone 22, wherein a tiered portion 28 facing downward is formed at the lower end of the central hole 24 of the nose cone 22 and the packing B is attached to the tiered portion 28 facing downward. The upper end surface 6*a* of the holder 6 and the ink container A are used to press the packing B to prevent the vent hole 17 from communicating with the outside air, that is, with the central hole 24 of the nose cone 22, the blind hole 27 and further the inside of the holder 6 to prevent the absorbent in the ink container A from drying.

Figure 6:
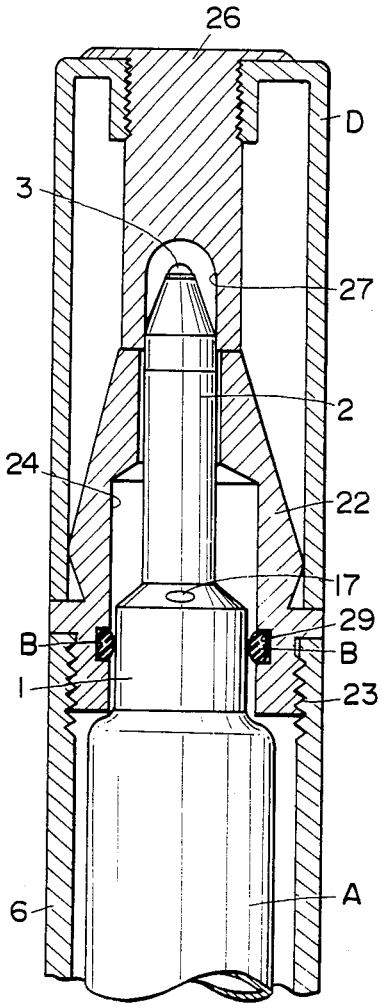

FIG. 6 is still another example, wherein the packing B shown in FIG. 5 is engaged with a circular groove 29 provided in the inside peripheral surface close to the lower end of the central hole 24 of the nose cone 22 to allow the outside pheripheral surface of the ink container A to tightly attach thereto so as to cut off the communication of the vent hole 17 with the outside air. Thus the same effects as shown in FIGS. 1, 3 and 5 can be accomplished.

As above described, by making the vent hole 17 of the ink container A in the nose cone 1 close to the nib 3, providing the airtight construction within the cap D of the nib and dividing the penholder into two parts, namely, the upper and lower holders 5, 6 for inserting the ink container A or instead of dividing the holer C, so arranging the holder that the ink container A can be inserted by removing the nose cone, the circulation of the air in the nib 3, the ink container A and the gap between the outside periphery of the ink container C and the inside periphery of the holder C can be cut off with the simple construction in which the vent hole 17 and the packing B are fitted close to the nose cone, so that the ink in the nib 3 and the ink container A are prevented from drying up.

What is claimed is:

1. A device for preventing the drying out of a nib of a cartridge-type pen comprising:

(a) packing material which surrounds and forms a hermetic seal between said packing material and an ink container, said packing material being inside and forming a hermetic seal between said packing material and a pen holder, said packing material itself being hermetic and said packing material being positioned between a vent hole in said ink container and the end opposite said nib of said pen, said vent hole and said packing material positioned close to the nib end of said ink container;

(b) a cap which fits over the nib end of said pen, said cap having an internal recess therein (c) an internal cap member which fits engagingly into said cap recess, said internal cap member having an internal blind hole for accommodating the nib end of said pen, said internal cap member having a first circular projection, said projection facing the interior of said blind hole and positioned towards the opening of said blind hole;

(d) a second circular projection positioned on said pen holder at the nib end of said pen holder such that when said cap is placed on the nib end of said pen, said first circular projection engages said second circular projection to form a hermetic seal; and (e) a bag-shaped cylinder lining the interior of said blind hole and extending towards the opening in said blind hole such that when said first circular projection engages said second circular projection said bag-shaped cylinder contacts the nib end of said pen holder to form a seal, such that, said packing material, said internal cap and said bag-shaped cylinder prevent the nib end of said pen from drying out.

2. The device as set forth in claim 1, wherein said packing material has a ring-like form and is seated on a first step formed in a neck portion of said pen holder and said packing material is pressed by a second step on said ink container such that air does not communicate between said vent hole and the interior of said pen holder.

3. The device as set forth in claim 1, wherein said packing material is formed as a cylinder provided with an annular projection formed on the inner surface thereof and provided also with an upper flange such that a cylindrical part is formed at the lower end thereof, said cylindrical part being inserted into a neck portion of said pen holder such that said flange contacts the lower end of said neck portion and said cylinder receives said ink container, thereby preventing the communication between said vent hole and ambient air.

4. The device as set forth in claim 1, wherein said packing material has a form like an "O" ring and is received by an annular recess formed in the inner wall of a neck portion of said pen holder and said vent hole is formed in an outwardly directed tapered surface of said ink container, thereby preventing the communication between said vent hole and ambient air.

5. A device for preventing ink in a nib of a pen from drying up comprising:

(a) pen holder for holding an ink container therein, one end of said holder open for said nib to extend through;

(b) packing material which surrounds said ink container and forms a hermetic seal between said ink container and said pen holder, said packing material being positioned close to said nib;

(c) a vent hole in said ink container, said vent hole being positioned closer to said nib than said packing material such that said vent hole is hermetically sealed from air in the interior of said holder;

(d) a cap which fits over the nib end of said pen, said cap having an internal recess therein;

(e) an internal cap member which fits engagingly into said cap recess, said internal cap member having an internal blind hole for accommodating the nib end of said pen, said internal cap member having a first circular projection, said projection facing the interior of said blind hole and positioned towards the opening of said blind hole;

(f) a second circular projection positioned on said pen holder at the nib end of said pen holder such that when said cap is placed on the nib end of said pen, said first circular projection engages said second circular projection to form a hermetic seal; and (g) a bag-shaped cylinder lining the interior of said blind hole and extending towards the opening in said blind hole such that when said first circular projection engages said second circular projection said bag-shaped cylinder contacts the nib end of said pen holder to form a seal, such that, said packing material, said internal cap and said bag-shaped cylinder prevent the nib end of said pen from drying out.

* * * * *